US008161583B1

(12) United States Patent
Palen

(10) Patent No.: US 8,161,583 B1
(45) Date of Patent: Apr. 24, 2012

(54) EASY CHANGE SUPPORT BED PAD

(76) Inventor: Terry Lynn Palen, Caledonia, MN (US)

( * ) Notice: Subject to any disclaimer, the term of this patent is extended or adjusted under 35 U.S.C. 154(b) by 0 days.

(21) Appl. No.: 12/930,291

(22) Filed: Jan. 3, 2011

Related U.S. Application Data

(63) Continuation-in-part of application No. 12/799,802, filed on May 3, 2010, now abandoned.

(51) Int. Cl.
*A61G 7/14* (2006.01)

(52) U.S. Cl. ..... 5/81.1 T; 5/81.1 HS; 5/89.1

(58) Field of Classification Search ..... 5/81.1 T, 5/81.1 HS, 88.1, 89.1, 484, 486, 612, 695
See application file for complete search history.

(56) References Cited

U.S. PATENT DOCUMENTS 1,334,901 A * 3/1920 Higdon ..... 5/500
4,536,903 A * 8/1985 Parker ..... 5/81.1 T
4,675,925 A * 6/1987 Littleton ..... 5/607
4,843,665 A * 7/1989 Cockel et al. ..... 5/88.1
4,872,226 A * 10/1989 Lonardo ..... 5/81.1 T
5,329,655 A 7/1994 Garner
5,787,523 A * 8/1998 Lindberg ..... 5/81.1 HS
6,560,793 B2 5/2003 Walker
6,658,676 B1 * 12/2003 Persson et al. ..... 5/81.1 HS
6,874,176 B2 4/2005 Berge
2009/0183309 A1 * 7/2009 Stinson ..... 5/81.1 T

* cited by examiner

*Primary Examiner* — Michael Trettel
(74) *Attorney, Agent, or Firm* — Harpman & Harpman

(57) ABSTRACT

A bed turning composite dual pad system to facilitate the care of a patient used in changing their position on a bed while providing clear access to their backside as required. A base pad is positioned under a patient with a centrally aligned longitudinally offset contoured opening within allowing the caregiver to easily turn and roll a patient with the base pad for ease of care access position. An adaptable absorbent cover pad is removably affixed over the contoured opening on the underside of the base pad for liquid containment management if needed.

6 Claims, 2 Drawing Sheets

EASY CHANGE SUPPORT BED PAD

This application is a continuation in part patent application Ser. No. 12/799,802, filed May 3, 2010, now abandoned.

BACKGROUND OF THE INVENTION

1. Technical Field

This invention relates to bed pads/slings and sheets that have been developed to aid caregivers in moving and repositioning bed ridden patients to provide required daily care. Patients must be moved by the caregiver for changing soiled undergarments and the like. The use of an under layment sheet that can be pulled around the patient and thereby assist in turning the patient without direct force contact of the caregiver is preferable to the patient given the typical skin condition in such patients which tears easily or other contact injuries which may occur during patient's fragile body and skin condition movement.

2. Description of Prior Art

Prior art devices of this type can be seen in U.S. Pat. Nos. 1,334,901, 4,843,665, 5,329,655, 5,787,523, 6,560,793 and 6,874,176.

In U.S. Pat. No. 1,334,901 a turning sheet and pad is disclosed having a rectangular sheet with centrally positioned absorbent pad thereon. The sheet is placed transversely across the bed under the patient's upper torso and hips.

U.S. Pat. No. 4,843,665 is directed to a patient transport and bed comfort aid and a fabric sling over the bed's mattress. The sling is secured to multiple extendable post that can lift the sling with the patient off the bed vertically.

U.S. Pat. No. 5,329,655 discloses a slidable hospital bed sheet for turning patients, having a bottom sheet with a central portion of a reduced friction engagement surface.

U.S. Pat. No. 5,787,523 is directed to a patient's sliding sheet with a liquid absorbing layer. A top sheet having multiple oppositely disposed high and low friction surfaces is disclosed.

U.S. Pat. No. 6,560,739 claims a single attendant patient care device comprising a draw sheet with a low friction underside surface and multiple removable body straps. The straps allow for selective patient engagement and movement thereof by a sole attendant in sequential fashion.

U.S. Pat. No. 6,874,176 illustrates a bed mat assembly to prevent bed sores. A draw sheet is combined with a displacement mat thereon and caregiver engagement poles on oppositely disposed parallel edges.

SUMMARY OF THE INVENTION

An easy change bed pad access system for repositioning and support of patients by a caregiver required for daily changing of soiled undergarments. A primary base pad is provided of a generally rectangular dimension positioned on a bed. The base pad has a centralized uniquely contoured opening therewithin to provide superior support to the patient's lower extremities while maintaining ease of caregiver access to the patient after grasping along one edge and pulled by the caregiver thus engaged and turn by the primary base pad. A waterproof and liquid absorbent quilted secondary cover pad is removably positioned over the opening. The bed pad system provides for safe, soft and secure patient engagement and movement without risking direct pulling force contact and associated injury due to the delicate nature of the patient's skin as is found in this environment. The secondary detachable cover pad can be replaced as needed.

DETAILED DESCRIPTION OF THE INVENTION

Figure 1:
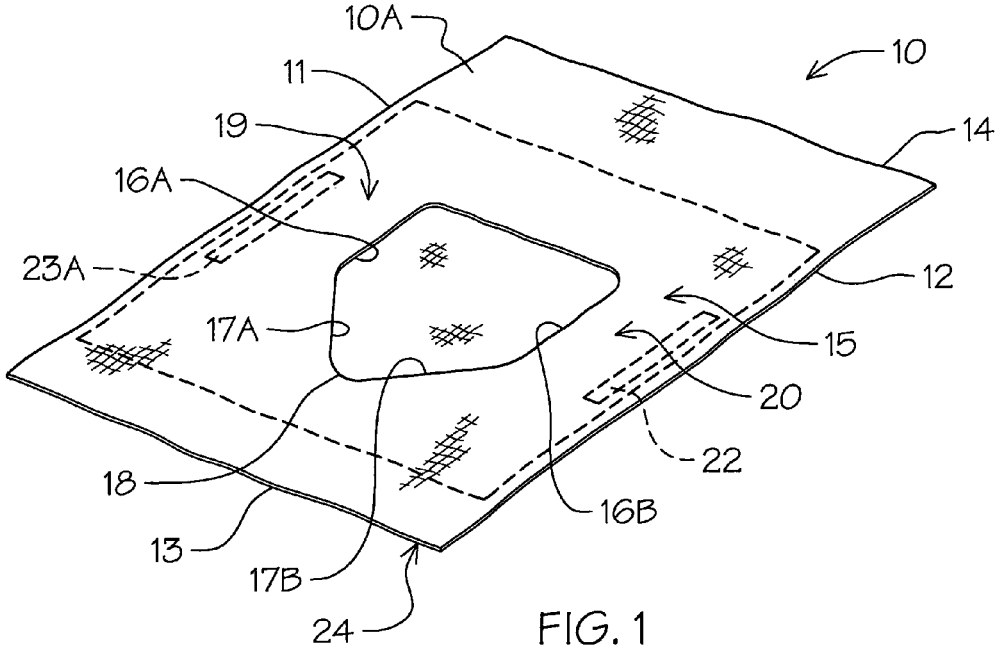
FIG. 1 is a top perspective view of the patient engagement pad system of the invention.

Referring to FIG. 1 of the drawings, the patient pad system 10 of the invention can be seen having a generally rectangular base pad 10A with oppositely disposed longitudinally extending perimeter edges 11 and 12. Corresponding interconnecting perimeter end edges 13 and 14 define a main body member 15 thereof. The base pad 10A is preferably made of multi-layered waterproof reusable fabric material. A patient care access opening 16 is formed within the central field of the main body member 15 and is of a known contoured dimension. The opening 16 has a parallel spaced inner edge sides 16A and 16B, and an interconnecting top surface 16C. Angularly disposed opposing bottom end edges 17A and 17B intersect at 18 defining the contoured dimensional opening 16.

It will be noted that the opening 16 is located centrally between the pads 10A respective perimeter edges 11 and 12 defining equal areas 19 and 20 of remaining side pad surfaces.

In contrast, the longitudinal orientation of the opening 16 in the main body member 15 is biased towards the perimeter bottom end edge 13 providing therefore a remaining surface area of increased dimension at 21.

This longitudinal access orientation of the opening 16 and its contoured shape is needed to accommodate patient's positioning thereon during use as will be described in detail hereinafter.

Figure 2:
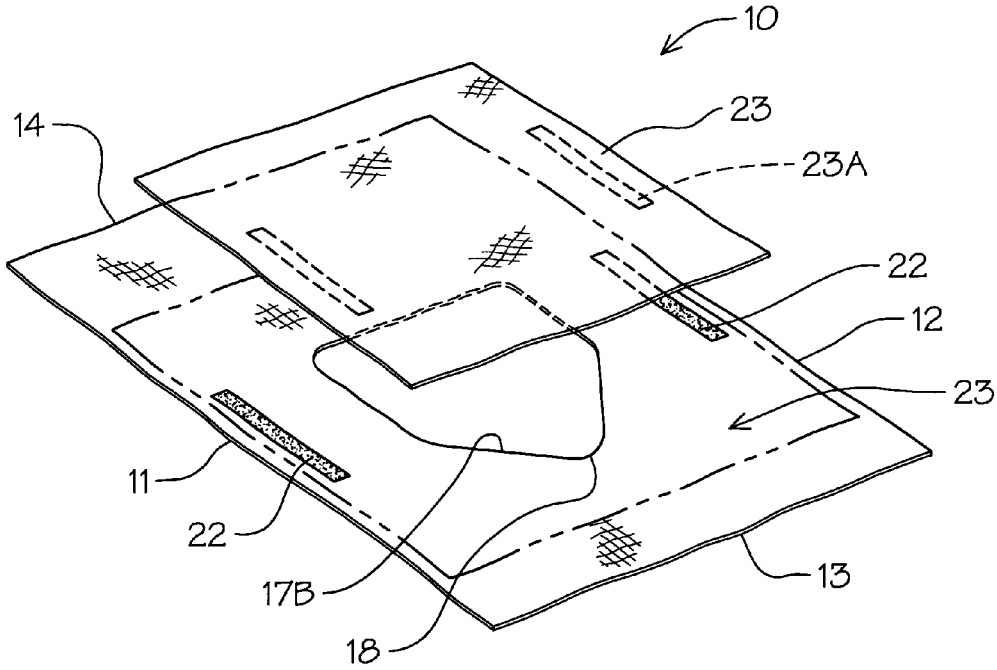
FIG. 2 is a bottom perspective view of the pad system configuration illustrating a removable opening cover pad.

Referring now to FIGS. 1 and 2 of the drawings, a patient pad 10A and its main body member 15 as hereinbefore disclosed has a pair of spaced parallel wide bands 22 of hook and loop interengagement material known commercially under the brand name of "Velcro". The bands 22 of hook and loop material are positioned on either side of the opening 16 adjacent the respective perimeter edges 11 and 12 on its upper surface 15A.

A waterproof absorbent cover pad 23 is provided having a dimension greater than that of the opening 16 and less than that of the pad 10. Corresponding thin narrow bands 23 of hook and loop material are secured to the cover pad 23 so as to be in alternate registering alignment with the hook and loop bands 22 when positioned thereover for removably securing the cover pad 23 selectively over the opening 16 on the underside 24 of the base pad 10A as so illustrated by broken lines in FIG. 1 of the drawings and in exploded view in FIG. 2 of the drawings.

Both the cover pad 23 and base pad 10A are made of a multiple layered construction having one sided waterproof moisture absorbent middle layer and material and a "top" layer patient engagement layer of a cotton polyester blend. The cover pad 23 can be easily removed, washed and re-used, as required. It will also be apparent to those skilled in the art that a modified disposable cover pad (not shown) could be used for a one time disposable use the surfaces are so configured as to be engageable by the hook portion of the hook and loop material positioned in such suggested application over the opening 16 as hereinbefore described.

The easy change patient pad system 10 provided with the removable Velcro™ secured cover pad 23 provides an use configuration to enhance the maintenance and care of the patient by providing a secondary containment barrier directly under a patient P which in some situations may be required as to be anticipatory of patient's needs and requirements.

Figure 4:
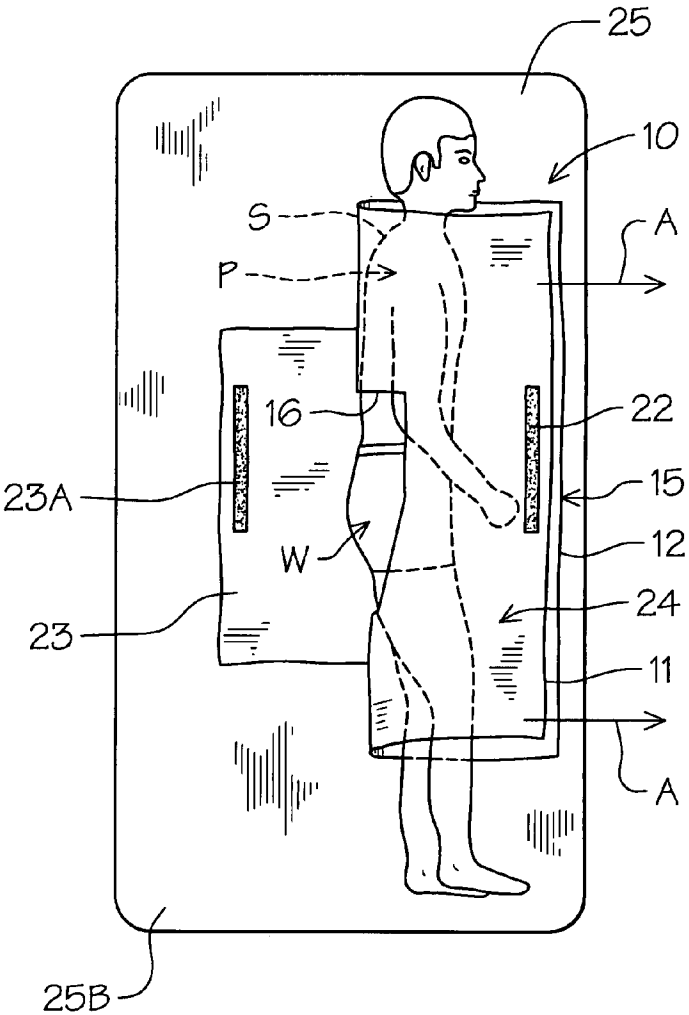
FIG. 4 is a top plan illustration view of the patient engagement pad engaged and moving a patient.
Figure 3:
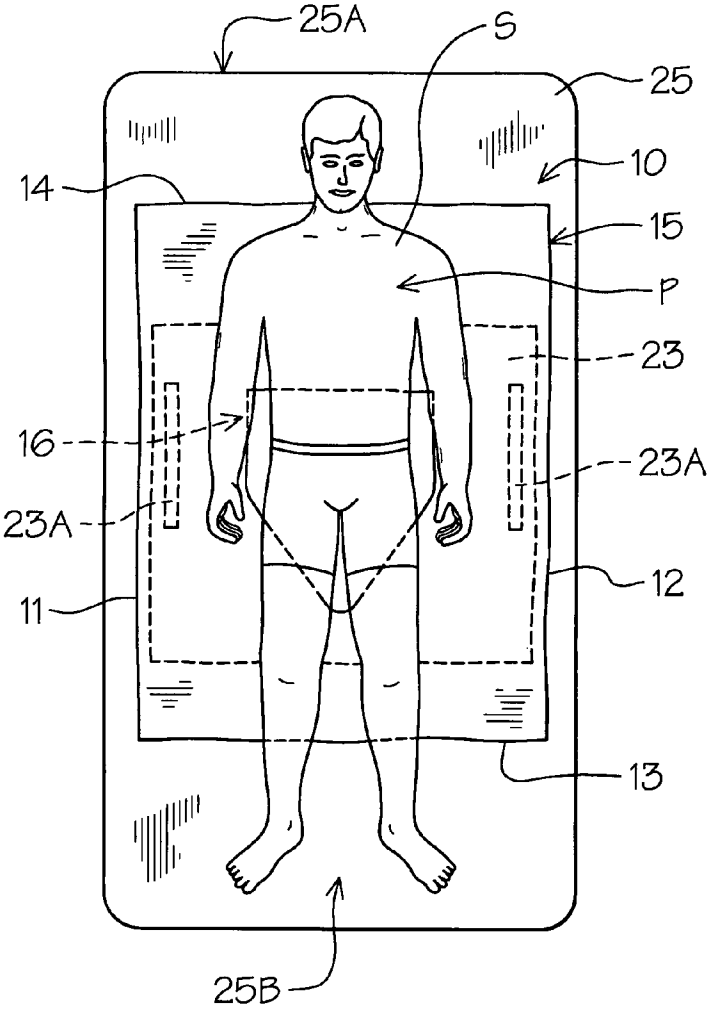
FIG. 3 is a top plan view illustrating the patient engagement pad system on a bed with a patient positioned thereon.

Referring now to FIGS. 3 and 4 of the drawings, a patient's bed 24 can be seen illustrated graphically with the patient pad system 10 of the invention positioned thereon for use. The bed 24 is oriented in this example with the head of the bed at 24A.

The patient pad system 10 of the invention is of an overall longitudinal length less than that of the bed 24 so that as positioned thereon for use it will be in spaced relation to the head of the bed at 24A. Its transverse dimension is equal to or marginally less that that of the bed at 24B.

The patient P is illustrated graphically on the dual component patient pad system 10 which is positioned to extend from the patient's shoulders S downwardly under the torso of the patient and the patient's legs. Accordingly, the upper torso orientation of the pad system 10 therefore automatically positions the hereinbefore described pads access opening at 16 centrally on the patient's mid-section about their waist W so indicated in solid and dotted lines in FIG. 3 of the drawings. It will be evident that by the unique contoured nature of the access opening 16 that the corresponding angular bottom end edges 17A and 17B that the bottom conforms to the patient's body shape thus providing additional and needed translateral support thereto.

Referring now to FIG. 4 of the drawings (during use) the pad system 10 has been grasped by a care worker (not shown) indicated by force engagement arrows A and the patient P is swaddled and turned by gathering the pad's longitudinal edge 11 over the patient P and towards the oppositely disposed parallel perimeter pad edge 12. This action reveals the patient care contoured access opening 16 with the cover pad 23 thereover allowing for removal thereof, shown partially removed with the patient P presented properly for the caregiver's ability to change the patient's soiled undergarment as required without having to hold the patient and reposition the patient multiple times as is currently required by direct contact.

It will thus be seen that a new and novel "easy change bed pad" of the invention has been illustrated and described which allows the caregiver to easily reposition the patient for required access for the changing of soiled undergarments as is required in such care facilities or home application situations.

As noted, it will be seen that such a device has been illustrated and described and it will be apparent to those skilled in the art that various changes and modifications may be made thereto without departing from the spirit of the invention.

Therefore I claim:

1. A composite dual pad configuration for repositioning and access to patients in a bed comprising, a substantially base rectangular pad positioned on the bed of a known length, said base pad having elongated spaced parallel perimeter side edges for grasping, a contoured access opening within said base pad having spaced parallel inside edges and opposing angularly disposed intersecting end inside edges extending therefrom defining an access portal to the patient, said contoured access opening in said base pad defines equilateral retainment pad surfaces on either side thereof and non-equilateral retainment pad surfaces on respected opposite ends thereof, a cover pad selective secured to said first pad underlying said contoured access opening therewithin, said base pad has a first pair of parallel selective engageable attachment strips adjacent said respective perimeter side edges thereof and said cover pad has second pair of selectively engageable attachment strips for aligned registration with said first pair of engagement strips.

2. The patient composite dual pad set forth in claim 1 wherein said base pad and said cover pad is of a multi-layer with a liquid proof side and an absorbent side of reusable flexible material.

3. The composite dual pad set forth in claim 1 wherein said base pad is of a length less than that of said known length of said bed.

4. The composite dual pad set forth in claim 1 wherein said contoured access opening is positioned under said patient defined by patient positioning on said base pad.

5. The composite dual pad set forth in claim 1 wherein said cover pad selectively secured under said opening in said pad is disposable.

6. The composite dual pad set forth in claim 4 wherein said patient positioning on said base pad comprises, patient shoulders afforded orientation below an end edge of said base pad which is in spaced relation to a corresponding end of said bed.

* * * * *